US009478870B2

(12) United States Patent
Desclos et al.

(10) Patent No.: US 9,478,870 B2
(45) Date of Patent: Oct. 25, 2016

(54) ANTENNA WITH PROXIMITY SENSOR FUNCTION

(71) Applicants: Laurent Desclos, San Diego, CA (US); Sebastian Rowson, San Diego, CA (US); Jeffrey Shamblin, San Marcos, CA (US)

(72) Inventors: Laurent Desclos, San Diego, CA (US); Sebastian Rowson, San Diego, CA (US); Jeffrey Shamblin, San Marcos, CA (US)

(73) Assignee: ETHERTRONICS, INC., San Diego, CA (US)

( * ) Notice: Subject to any disclaimer, the term of this patent is extended or adjusted under 35 U.S.C. 154(b) by 336 days.

(21) Appl. No.: 13/965,101

(22) Filed: Aug. 12, 2013

(65) Prior Publication Data

US 2014/0071008 A1 Mar. 13, 2014

Related U.S. Application Data

(60) Provisional application No. 61/682,145, filed on Aug. 10, 2012.

(51) Int. Cl.

| | |
|---|---|
| ***H01Q 9/00*** | (2006.01) |
| ***H01Q 19/02*** | (2006.01) |
| ***H01Q 1/24*** | (2006.01) |
| ***H01Q 1/44*** | (2006.01) |
| ***H01Q 9/14*** | (2006.01) |
| ***H01Q 5/378*** | (2015.01) |
| ***H01Q 5/385*** | (2015.01) |
| ***H01Q 5/392*** | (2015.01) |

(52) U.S. Cl.

CPC ..... *H01Q 19/021* (2013.01); *H01Q 1/243* (2013.01); *H01Q 1/245* (2013.01); *H01Q 1/44* (2013.01); *H01Q 5/378* (2015.01); *H01Q 5/385* (2015.01); *H01Q 5/392* (2015.01); *H01Q 9/14* (2013.01)

(58) Field of Classification Search

CPC ..... H01Q 25/04; H01Q 9/145; H01Q 9/30; H01Q 9/14; H01Q 23/00; H01Q 1/243; H01Q 19/02

USPC ..... 343/745, 702, 850, 876, 833, 834

See application file for complete search history.

(56) References Cited

U.S. PATENT DOCUMENTS

| | | | | |
|---|---|---|---|---|
| 7,003,519 | B1 * | 2/2006 | Biettron | G06F 17/30713 707/711 |
| 7,180,464 | B2 * | 2/2007 | Chiang | H01Q 1/242 343/702 |
| 7,834,813 | B2 * | 11/2010 | Caimi | H01Q 9/045 343/745 |
| 8,928,540 | B2 * | 1/2015 | Desclos | H01Q 25/04 343/702 |
| 2005/0264455 | A1 * | 12/2005 | Talvitie | H01Q 9/0442 343/702 |
| 2006/0017635 | A1 * | 1/2006 | Zheng | H01Q 7/00 343/748 |

* cited by examiner

*Primary Examiner* — Huedung Mancuso

(74) *Attorney, Agent, or Firm* — Coastal Patent Law Group, P.C.

(57) ABSTRACT

An antenna with proximity sensor function is disclosed, the antenna includes at least one parasitic element coupled to a filter circuit and a proximity sensing circuit for sensing a load on the parasitic element to determine capacitive loading characteristics for sensing user loading of the device. By sensing the user loading or mode of the device, the antenna can be reconfigured with beam steering or frequency shifting adjustments.

14 Claims, 4 Drawing Sheets

ANTENNA WITH PROXIMITY SENSOR FUNCTION

CROSS-REFERENCE TO RELATED APPLICATIONS

This application claims benefit of priority with U.S. Provisional Ser. No. 61/682,145, filed Aug. 10, 2012.

BACKGROUND OF THE INVENTION

1. Field of the Invention

This invention relates to antennas for use in wireless communications; and more particularly, to an antenna with proximity sensor function.

2. Description of the Related Art

Proximity sensors are in use in commercial wireless devices as well as other product groups, and are used for a wide variety of applications. For example, it is common for a proximity sensor to be integrated into a cell phone, with the proximity sensor used to sense when the display region of the cell phone is in close proximity to an object. This sensing of an object close to the display is used to reduce battery power consumption by turning off or down the brightness of the display when the display is in close proximity to a user's head or the display is covered by an object. Another application of a proximity sensor is to integrate the sensor into a Tablet computing device and use the sensor to sense proximity of the user's body to the Tablet. When the user's body is close to the Tablet, the transmit power of the cellular transceiver is reduced to allow the Tablet to meet requirements for specific absorption rate (SAR).

One implementation of a proximity sensor is a capacitive sensor, and is effectively a parallel plate capacitor. A dielectric material is positioned between the two plates to provide support and maintain a set separation distance between the plates. Two conductors are used to connect the two plates to a circuit that monitors capacitance. As objects are placed in proximity to the capacitor the objects interact with the fringing electric field emanating from the region between and external to the plates. This interference with the fringing fields of the capacitor translates into a change in capacitance.

Multiple proximity sensors can be integrated into a device and used to provide more information on the environment and changes to the environment. Multiple problems arise in integrating proximity sensors into a device such as finding volume for the proximity sensors, incurring the cost of the sensors, and positioning the sensors at locations that are desirable, such as close to the antenna system.

SUMMARY OF THE INVENTION

An antenna with proximity sensor function is disclosed, the antenna includes at least one parasitic element coupled to a filter circuit and a proximity sensing circuit for sensing a load on the parasitic element to determine capacitive loading characteristics for sensing user loading of the device. By sensing the user loading, or mode of the device, the antenna can be reconfigured with beam steering or frequency shifting adjustments.

DETAILED DESCRIPTION OF THE PREFERRED EMBODIMENTS

Figure 1:
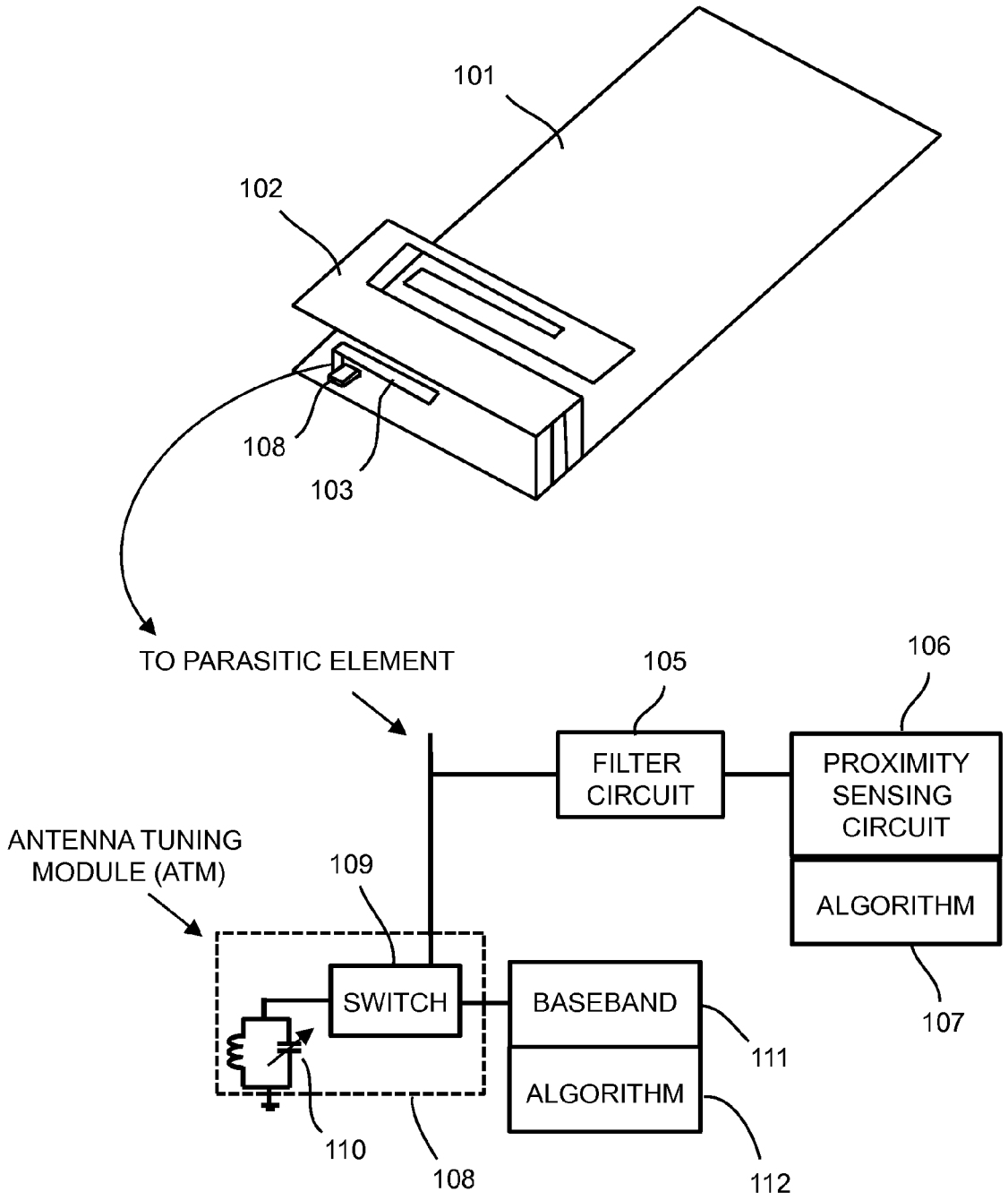
FIG. 1 shows an antenna with proximity sensor function in accordance with an embodiment.

A proximity sensor can be positioned beside or beneath an antenna and the antenna can be re-tuned to compensate for the effect of placing the metal conductors near the antenna. A more efficient method in terms of maintaining antenna performance, reducing volume required, and saving cost is to design the proximity sensor into the antenna structure. This combination antenna and proximity sensor provides a more optimized and cost effective solution for devices that require antennas and proximity sensing systems. More importantly, by designing the proximity sensor, or multiple proximity sensors into the antenna, the ability to detect changes to the environment in the region of the antenna can be improved. Sensing when objects are in close proximity to an antenna can be used to assist in re-tuning the antenna and keeping the antenna impedance optimized.

In certain embodiments a parasitic element is positioned beneath a radiating antenna element, with this parasitic element used to shift the frequency response of the antenna. A second active antenna topology developed consists of a parasitic element positioned in close proximity but outside of the volume of the main antenna, with this "offset" parasitic element used to alter the radiation mode, and in turn the pattern characteristics of the main antenna. These modal antennas are capable of beam-steering and band-switching and are further described in U.S. Ser. No. 13/726,477, filed Dec. 24, 2012; which is related to U.S. Pat. No. 8,362,962, issued Jan. 29, 2013; and U.S. Pat. No. 7,911,402, issued Mar. 22, 2011; each of which are commonly owned and their contents are hereby incorporated by reference. The parasitic elements described in these examples can also be used as a proximity sensor. The parasitic element can be coupled using a filter circuit to separate the high frequency RF component at the frequency of operation of the antenna from the low frequency signal required for the proximity sensing function. The parasitic element can be designed to operate as a proximity sensor by using blocking capacitors to isolate the parasitic element from ground at DC and present a high impedance at the lower frequencies used for proximity sensing.

In one embodiment, an antenna element is coupled to a ground plane with a parasitic element beneath the antenna element. The parasitic element is configured to shift the frequency response of the antenna when a reactive load or change in reactance is applied to the parasitic element at the junction of the parasitic element and the ground plane, or at locations along the parasitic element. A filtering circuit is coupled to the parasitic element, with the filtering circuit connecting the parasitic element to a proximity sensing circuit.

In an embodiment, two or more parasitic elements are positioned beneath the antenna element, and one or more of the parasitic elements is connected to a filtering circuit which in turn is connected to a proximity sensing circuit.

In another embodiment, an antenna element is coupled to a ground plane with a parasitic element positioned in close proximity to the antenna element. The parasitic element is configured to alter the radiation mode of the antenna, which in turn will alter the radiation pattern characteristics of the antenna. The radiation mode is altered when a reactive load or change in reactance is applied to the parasitic element at the junction of the parasitic element and the ground plane, or at locations along the parasitic element. A filtering circuit is coupled to the parasitic element, with the filtering circuit connecting the parasitic element to a proximity sensing circuit.

In another embodiment, an antenna is positioned in proximity to a ground plane wherein the antenna is not connected to the ground plane. A filtering circuit is coupled to the antenna, with the filtering circuit connecting the antenna to a proximity sensing circuit. The antenna can be used for transmission and/or receiving RF signals and the antenna structure acts as a proximity sensor.

In yet another embodiment, an antenna is provided wherein conductors are attached at multiple locations; with these conductors coupled to one or more filter circuits to couple the conductors to a proximity sensing circuit.

Now turning to the drawings, FIG. 1 shows an antenna with proximity sensor function in accordance with an embodiment. The antenna is implemented as an active modal antenna described above, having an antenna radiator 102 positioned above a ground plane 101 forming an antenna volume therebetween. A parasitic element 103 is positioned within the antenna volume. The parasitic element 103 is coupled to an antenna tuning module (ATM) 108 and a filter circuit 105. The ATM 108 comprises a switch 109 and one or more tunable components including tunable capacitors 110, tunable inductors, or tunable phase shifters. The ATM is further coupled to a baseband processor 111 or a separate processor with an algorithm 112 for controlling the parasitic element 103. The filter circuit 105 is coupled to a proximity sensing circuit 106 and algorithm 107 for sensing capacitive load on the parasitic element as a mechanism for sensing proximity of user extremities.

Figure 2:
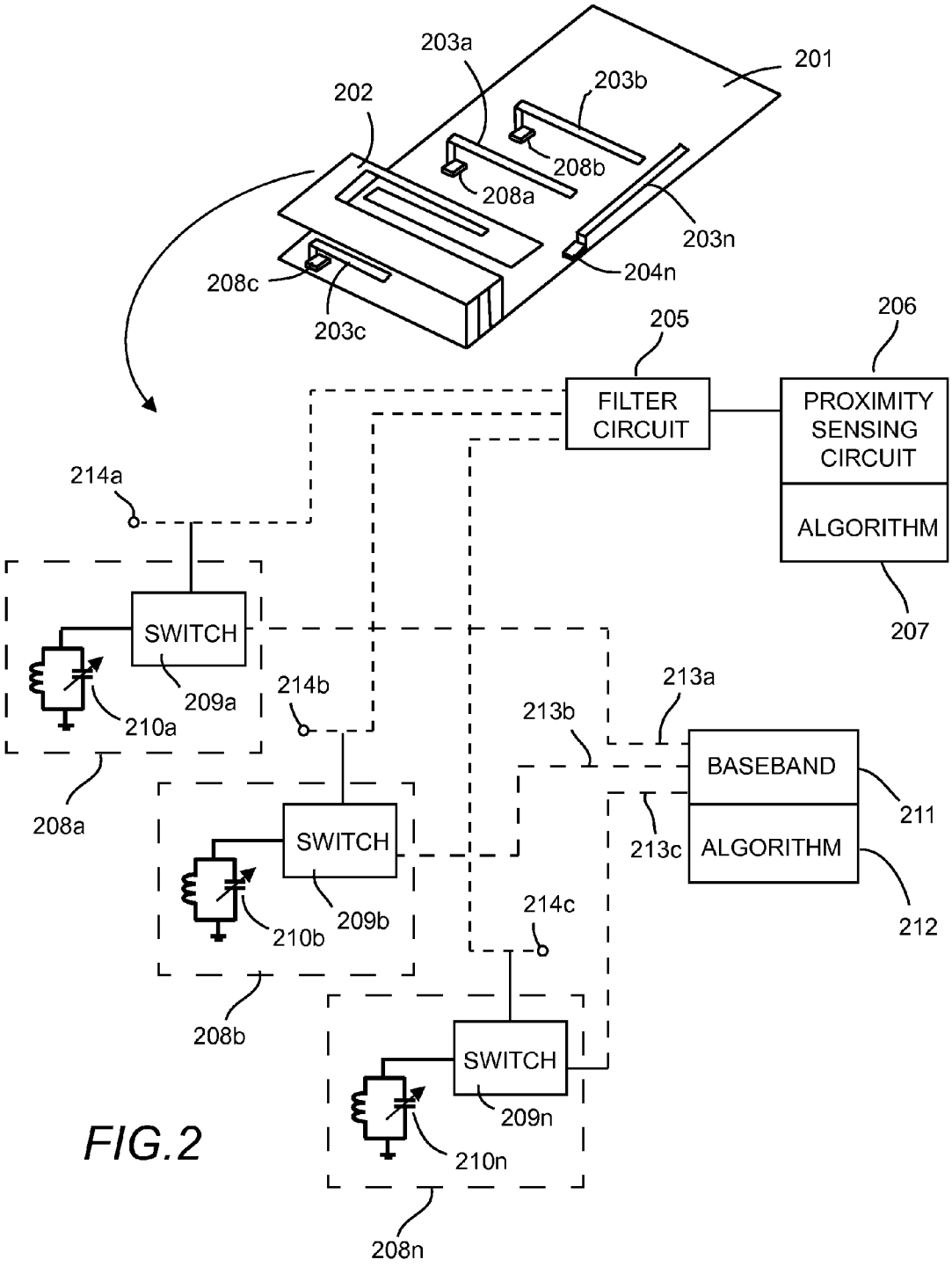
FIG. 2 shows an active modal antenna with n parasitic elements and proximity sensors in accordance with another embodiment.

FIG. 2 shows an active modal antenna with n parasitic elements and proximity sensors in accordance with another embodiment. This embodiment is similar to FIG. 1 having an antenna radiator 202 positioned above a ground plane 201, and first parasitic element 203*a* adjacent to the antenna radiator, but with the additional parasitic elements 203*b*; 203*c*; and 203*n*, respectively. One parasitic element is shown within the antenna volume, and three additional parasitic elements are shown as positioned outside of the antenna volume. Each parasitic element is coupled to a distinct ATM 208*a*; 208*b*; 208*c*; and 208*n*, and each of the ATM's are further coupled to the baseband 211 or other processor having an algorithm 212 for controlling the parasitic element function. Each ATM is further coupled to the filter circuit 205, which incorporates a proximity sensing circuit 206 and an algorithm 207 for sensing capacitive load on the parasitic element as a mechanism for sensing proximity of user extremities. As in the example of FIG. 1, each of the ATMs 208(*a, b, c . . . n*) individually comprises a switch 209(*a, b, c . . . n*) and one or more tunable components including tunable capacitors 210(*a, b, c . . . n*), tunable inductors, or tunable phase shifters. The tunable components and baseband control signals are coupled to a parasitic element through a respective switch within the ATM.

Figure 3:
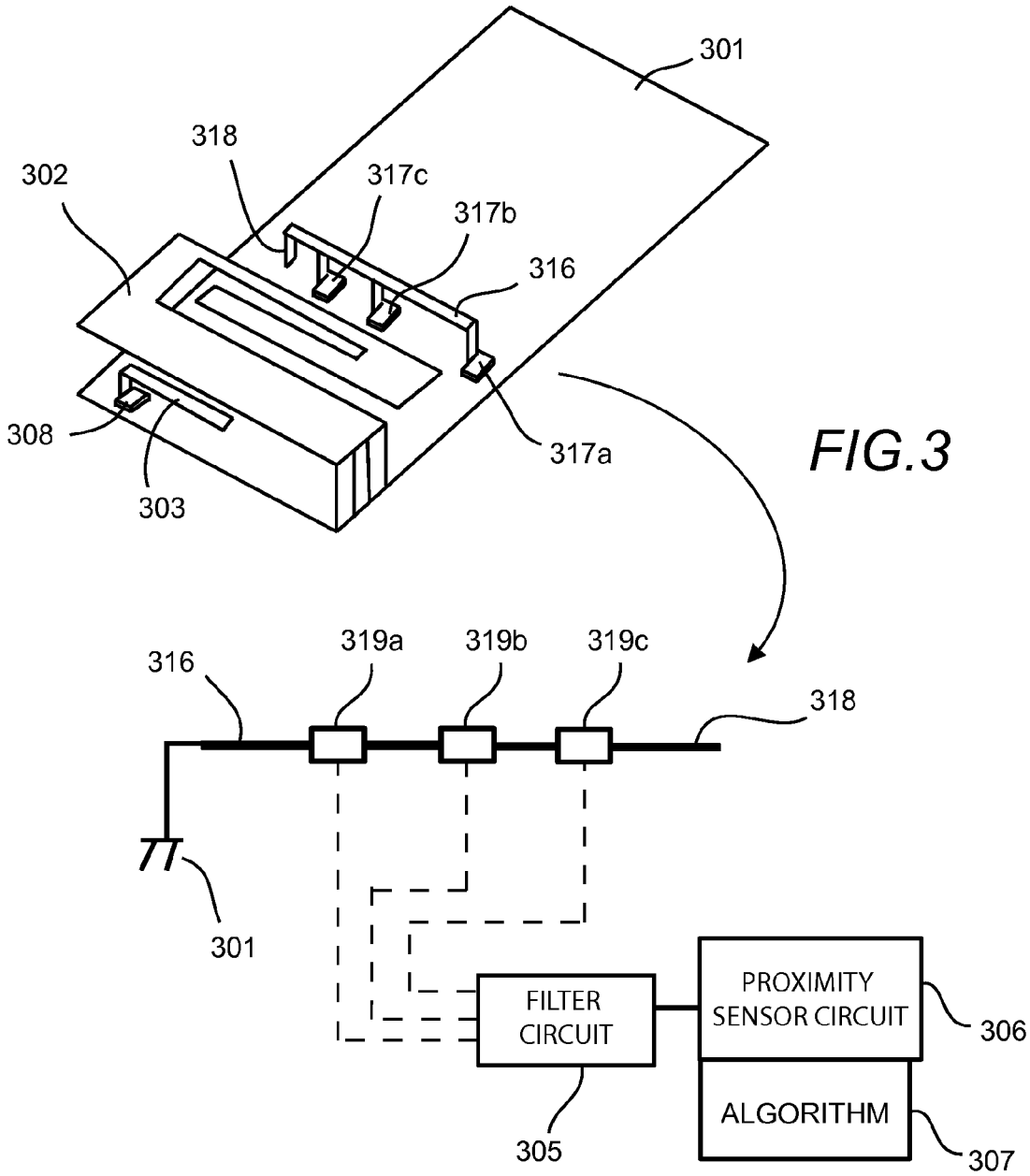
FIG. 3 shows an antenna with proximity sensor function in accordance with another embodiment.

FIG. 3 shows an antenna with proximity sensor function in accordance with another embodiment. Here, first parasitic element 303 and ATM 308 are positioned beneath an antenna element 302 and within the antenna volume, as above, and a second parasitic element is positioned outside of the antenna volume. The second parasitic element comprises a plurality of portions, including a first portion 316 and a second portion 318, the first portion 316 is coupled to the ground plane at a first switch 317*a*, and the second portion 318 is isolated from the ground plane. Multiple portions can be integrated into the second parasitic for additional control; however, three portions are shown here, each portion coupled to the ground plane at a distinct switch (317*a*; 317*b*; 317*c*), and the terminal end of the second parasitic element 318 is isolated from the ground plane 301. Each of the switches is further coupled to a corresponding tunable component 319(*a-c*), and the tunable components are coupled to the filter circuit 305, which is further coupled to a proximity sensing circuit 306 and algorithm 307 as above.

Figure 4:
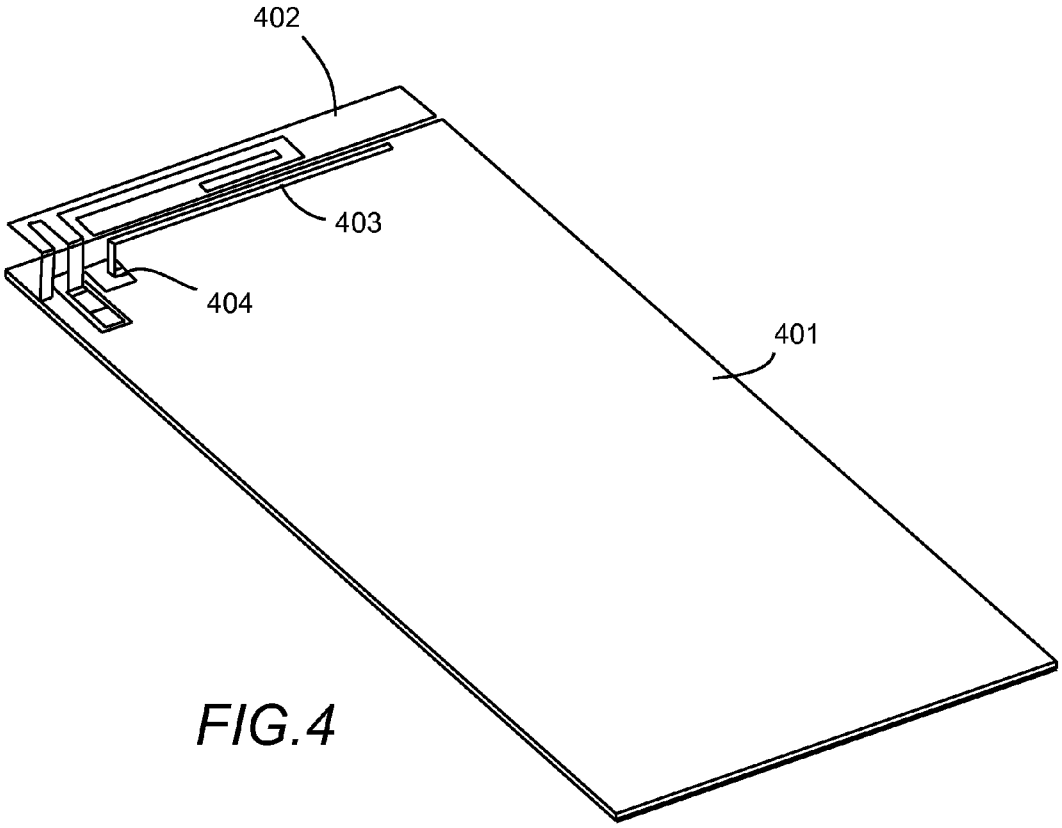
FIG. 4 shows an antenna with proximity sensor function, the antenna includes a parasitic element positioned within the antenna volume and configured for frequency shifting, and capacitors implemented to isolate the parasitic element at frequencies from the ground plane.

FIG. 4 shows an antenna with proximity sensor function, the antenna includes a parasitic element 403 positioned beneath an antenna radiating element 402 within the antenna volume for frequency shifting, and further includes capacitors 404 implemented to isolate the parasitic element at frequencies from the ground plane.

In the illustrated embodiments, the antenna components inherently provide the proximity sensor function, thereby eliminating the cost for additional capacitive sensors. Moreover, less energy is consumed by the system with less components for distributing power. Smaller antenna device form is achieved by reduced size due to reduced componentry requirements.

What is claimed is:

1. An antenna with proximity sensor function, comprising:

an antenna element coupled to a ground plane and forming an antenna volume therebetween;

a first parasitic element at least partially disposed within the antenna volume;

the first parasitic element being configured to shift a frequency response of the antenna when a change in reactance is applied to the first parasitic element at one of:

the junction of the first parasitic element and the ground plane, along the first parasitic element, or a combination thereof; and a filtering circuit coupled to the first parasitic element;

said filtering circuit being further coupled to a proximity sensing circuit;

wherein the first parasitic element is configured for both: sensing a loading on the antenna, and shifting a frequency response of the antenna.

2. The antenna system of claim 1, wherein two or more parasitic elements are positioned within the antenna volume.

3. The antenna of claim 2, wherein one or more of the parasitic elements are connected to the proximity sensing circuit through the filtering circuit.

4. The antenna system of claim 1, further comprising a second parasitic element disposed outside the antenna volume, wherein the second parasitic element is configured to steer a radiation pattern of the antenna when a change in reactance is applied to the second parasitic element.

5. The antenna system of claim 1, wherein said first parasitic element is coupled to an antenna tuning module, said antenna tuning module comprising a capacitor, inductor, switch, or a combination thereof, wherein the antenna tuning module is configured to vary a reactance associated with the first parasitic element.

6. The antenna system of claim 5, wherein said antenna tuning module comprises a switch, and wherein said switch is further coupled to a baseband processor, the baseband processor configured with an algorithm for controlling a tuning state of the antenna tuning module.

7. An antenna with proximity sensor function, comprising:

an antenna element coupled to a ground plane and forming an antenna volume therebetween;

a first parasitic element disposed in proximity with the antenna volume;

the first parasitic element being configured to shift the frequency response of the antenna when a change in reactance is applied to the first parasitic element;

a second parasitic element disposed in proximity with the antenna volume;

the second parasitic element being configured to steer a radiation pattern of the antenna when a change in reactance is applied to the second parasitic element; and a filtering circuit coupled to at least one of the first and second parasitic elements;

said filtering circuit being further coupled to a proximity sensing circuit;

wherein said at least one of the first and second parasitic elements is configured for both: sensing a loading on the antenna, and at least one of: shifting a frequency response of the antenna, or steering a radiation pattern of the antenna.

8. The antenna system of claim 7 comprising two or more first parasitic elements, wherein the two or more first parasitic elements are positioned within the antenna volume.

9. The antenna of claim 8, wherein the two or more first parasitic elements are connected to the proximity sensing circuit through the filtering circuit.

10. The antenna system of claim 7, wherein each of said first and second parasitic elements are coupled to a corresponding first and second antenna tuning module, each of said first and second antenna tuning modules individually comprising a capacitor, inductor, switch, or a combination thereof, wherein each of the first and second antenna tuning modules are independently configured to: vary a reactance associated with one of the first and second parasitic elements.

11. The antenna system of claim 10, wherein each of said first and second antenna tuning modules comprises a switch, and wherein each of said switches is further coupled to a baseband processor, the baseband processor configured with an algorithm for controlling a tuning state of the respective first and second antenna tuning modules.

12. The antenna system of claim 7, comprising an antenna tuning module, said antenna tuning module comprising a plurality of capacitors, inductors, switches, or combinations thereof, each of the first and second parasitic elements is coupled to one or more of the plurality of capacitors, inductors, switches, or combinations thereof for communicating a reactance therebetween.

13. An antenna positioned in proximity to a ground plane wherein the antenna is not connected to the ground plane, a filtering circuit is coupled to the antenna, with the filtering circuit connecting the antenna to a proximity sensing circuit, the antenna configured for at least one of: transmission and receiving radiofrequency signals, and at least a portion of the antenna is configured to function as a proximity sensor for sensing a load associated with the antenna.

14. The antenna of claim 13, having one or more parasitic elements positioned at multiple locations associated with the antenna, the one or more parasitic elements being coupled to a proximity sensing circuit through one or more filter circuits; wherein the parasitic elements function as proximity sensors.

* * * * *